US006106990A

United States Patent [19]

Tazawa et al.

[11] Patent Number: 6,106,990

[45] Date of Patent: Aug. 22, 2000

[54] PROCESS FOR PRODUCING TONER PARTICLES

[75] Inventors: Yayoi Tazawa, Mishima; Yoshinobu Baba, Yokohama; Hitoshi Itabashi, Yokohama; Yuzo Tokunaga, Yokohama; Yasukazu Ayaki, Numazu, all of Japan

[73] Assignee: Canon Kabushiki Kaisha, Tokyo, Japan

[21] Appl. No.: 09/362,885

[22] Filed: Jul. 29, 1999

[30] Foreign Application Priority Data

Jul. 31, 1998 [JP] Japan ..... 10-217445
Jul. 14, 1999 [JP] Japan ..... 11-200071

[51] Int. Cl.[7] ..... G03G 9/08

[52] U.S. Cl. ..... 430/137; 523/333; 523/334; 524/801

[58] Field of Search ..... 430/137; 523/333, 523/334; 524/801, 794

[56] References Cited

U.S. PATENT DOCUMENTS

| | | | |
|---|---|---|---|
| 2,297,691 | 10/1942 | Carlson | 95/5 |
| 5,482,812 | 1/1996 | Hopper et al. | 430/137 |
| 5,620,826 | 4/1997 | Tavernier et al. | 430/137 |
| 5,929,139 | 7/1999 | Mori et al. | 523/333 |

FOREIGN PATENT DOCUMENTS

| | | |
|---|---|---|
| 36-10231 | 7/1961 | Japan . |
| 42-23910 | 11/1967 | Japan . |
| 43-24748 | 10/1968 | Japan . |
| 56-13945 | 2/1981 | Japan . |
| 59-053856 | 3/1984 | Japan . |
| 59-061842 | 4/1984 | Japan . |
| 4-303849 | 10/1992 | Japan . |
| 8-179553 | 7/1996 | Japan . |
| 8-211655 | 8/1996 | Japan . |
| 8-248680 | 9/1996 | Japan . |
| 9-034167 | 2/1997 | Japan . |

*Primary Examiner*—Christopher D. RoDee
*Attorney, Agent, or Firm*—Fitzpartick, Cella, Harper & Scinto

[57] ABSTRACT

A process for producing toner particles is conducted by:

preparing toner precursor particles containing at least binder resin and coloring agent; and spherizing the toner precursor particles to obtain toner particles;

wherein spherizing steps include;

(1) dispersing the toner precursor particles in an aqueous medium containing a dispersant, thereby preparing a disperse system (a);

(2) dispersing oil droplet particles containing a softening agent into an aqueous medium, thereby preparing a disperse system (b);

(3) preparing a mixed disperse system (c) by adding the disperse system (a) to the disperse system (b), and causing the softening agent to be absorbed by the toner precursor particles in the mixed disperse system (c); and (4) removing the softening agent from the toner precursor particles.

16 Claims, No Drawings

PROCESS FOR PRODUCING TONER PARTICLES

BACKGROUND OF THE INVENTION

1. Field of the Invention

The present invention relates to toner particles for developing electrostatic charge images in image forming methods such as electrophotography and electrostatic printing, and also relates to a toner particle manufacturing method for manufacturing toner particles for forming toner images in image forming methods of the toner jet method.

2. Description of the Related Art

Various known electrophotography methods have been proposed in U.S. Pat. No. 2,297,691, Japanese Patent Publication No. 42-23910, and Japanese Patent Publication No. 43-24748. There are two developing methods in electrophotography, the dry developing method and the wet developing method. This dry developing method can be divided into two methods; a method which uses a two-component developer and a method which uses a one-component developer.

The toner particles used for the dry developing method are generally fine particles of colored resin, including as the main component binder resin and coloring agent, and the particle diameter thereof is generally within a range between 8 to 30 $\mu$m. A common manufacturing method for manufacturing such toner particles is the so-called pulverizing method, wherein binder resin, a coloring agent such as pigment and/or a magnetic substance, waxes, etc., are melt-kneaded, the kneaded material is cooled, the cooled kneaded material is pulverized, and the pulverized material is classified, thereby creating toner particles. The form of toner particles formed by this pulverizing method is a generally irregular shape with corners.

In recent years, the size of toner particles is being reduced in order to improve resolution and precision detail, and also many proposals have been made regarding rounded toner wherein the form of the toner particles is spherical, in order to improve transfer efficiency and flowability. For example, Japanese Patent Laid-Open No. 56-13945 discloses a method wherein a disk or multi-fluid nozzle is used to mist a molten mixture into the air, thereby obtaining rounded or spherized toner, but this method has problems regarding reduction of particle diameter.

Further, rounded toner particles can be manufactured by methods described in Japanese Patent Publication No. 36-10231, Japanese Patent Laid-Open No. 59-53856, and Japanese Patent Laid-Open No. 59-61842, such as methods for generating rounded toner particles by the suspension polymerizing method; the emulsion polymerizing method which is represented by the soap-free polymerizing method wherein polymerization is directly performed in the presence of an aqueous polar polymerization initiator, thereby obtaining rounded toner particles; or the dispersion polymerizing method wherein a solvent is used in which monomers are soluble but polymers are non-soluble, and toner particles are formed in this solvent. However, with each of these polymerizing methods, the binder resin included in the toner is restricted to vinyl resins.

Japanese Patent Laid-Open No. 4-303849 and Japanese Patent Laid-Open No. 8-211655 propose using the reverse-phase sedimentation method wherein water is added to a polyester resin solution. However, this method is restricted to polyester resin for the binder resin comprising the toner. Further, the above method involves dissolving the binder resin component with an organic solvent which is water-immiscible, into which pigments and other additives are dissolved and/or dispersed to form a liquid into which droplets or water are dropped, thereby obtaining rounded toner, so there is a problem in that great amounts of organic solvent must be used as to the resin component and maintain a state wherein sufficient fluidity is secured, as rounded toner cannot be obtained otherwise.

Further, with the method described in Japanese Patent Laid-Open No. 8-248680 as well, the binder resin component is dissolved with an organic solvent which is water-immiscible, and this solution is dispersed in an aqueous phase to form oil droplets, so there is a problem in that great amounts of organic solvent must be used to obtain sufficient fluidity.

Efforts are being made to create rounded or spherical toner by taking the pulverized toner obtained by the aforementioned common pulverization method and spherizing this toner either mechanically or by heat, but much time or energy must be spent in order to obtain truly spherical toner with such methods, so these methods are not economically feasible.

Japanese Patent Laid-Open No. 8-179553 and Japanese Patent Laid-Open No. 9-34167 disclose a method for producing toner, comprising the steps of: dispersing fine particles containing binder resin and coloring agent into an aqueous medium including a dispersant which is solid at room temperature, thus preparing a particle disperse liquid; mixing the obtained particle disperse liquid with a solvent disperse liquid which is water-immiscible, this solvent disperse liquid having been prepared by dispersing a hydrophobic solvent into an aqueous disperse liquid; and removing the hydrophobic solvent by heating and/or depressurizing the obtained mixed liquid, thereby forming particles into spherical or deformed shapes.

However, these Publications describe embodiments wherein the above particle disperse liquid and the solvent disperse liquid which is water-immiscible are mixed by adding the solvent disperse liquid which is water-immiscible to the particle disperse liquid, so coagulation of the fine particles in the particle disperse liquid readily occurs due to so-called solvent shock. In this process a problem occurs in that the obtained toner particles tend to become coarser and broadening of the particle distribution tends to occur.

As described above, there has not yet been discovered a method whereby spherical toner can easily be produced regardless of the resin component comprising the toner, and free of increase in particle size distribution and occurrence of coarse particles.

SUMMARY OF THE INVENTION

An object of the present invention is to solve the above-described problems in the known art, and to provide a method for easily producing spherical toner particles unrestricted by the type of resin component comprising the toner.

Another object of the present invention is to provide an excellent method for producing toner wherein, regardless of the rounding or spherizing process, the sharp particle size distribution of the toner particles is not lost, and there is no occurrence of large particles.

It is an object of the present invention to provide a process for producing toner particles, comprising the steps of:

preparing toner precursor particles containing at least binder resin and coloring agent; and spherizing the obtained toner precursor particles to obtain toner particles;

wherein the spherizing comprises:

(i) dispersing the toner precursor particles in an aqueous medium containing a dispersant, thereby preparing a disperse system (a);

(ii) dispersing oil droplet particles containing a softening agent into an aqueous medium, thereby preparing a disperse system (b);

(iii) preparing a mixed disperse system (c) by adding the disperse system (a) to the disperse system (b), and causing the softening agent to be absorbed by the toner precursor particles in the mixed disperse system (c); and (iv) removing the softening agent from the toner precursor particles.

DETAILED DESCRIPTION OF THE INVENTION

After careful study, the present inventors have found that in order to solve the above-described problems with the known art, toner precursor particles can be easily rounded by: separately preparing an aqueous medium disperse liquid (a) having toner precursor particles which have at least binder resin and coloring agent, and an aqueous medium disperse liquid (b) of oil droplet particles including a softening agent; subsequently adding the disperse liquid (a) to the disperse liquid (b) so as to prepare a mixed disperse liquid (c); whereby the toner precursor particles are caused to absorb the softening agent in the mixed disperse liquid; following which the softening agent is removed from the toner precursor particles. The present inventors have discovered that according to the above process, essentially spherical toner can easily be obtained, regardless of the type of binder resin component comprising the toner, the method of producing the toner precursor particles, or even the form of the toner precursor particles. The term "essentially spherical toner" here refers to toner having a shape factor (SF-1) of 100 to 120 as obtained by using a later-described image analyzer.

As employed herein, "toner parent particles" means the same as "toner precursor particles", and "rounding" means the same as "spherizing".

With the process for producing toner according to the present invention, a disperse liquid (a) having toner parent particles and a disperse liquid (b) of oil droplet particles including a softening agent are mixed to form a mixed disperse liquid (c), but at this time, it is crucial to form the mixed disperse liquid (c) by adding the disperse liquid (a) to the disperse liquid (b). In the event that this order is reversed and the disperse liquid (b) having oil droplet particles is added to the disperse liquid (a) including toner parent particles to obtain the mixed disperse liquid (c), coagulation of the toner parent particles may occur due to so-called solvent shock, consequently increasing the size of toner particles. Conversely, by using the mixing method wherein the disperse liquid (a) is added to the disperse liquid (b), the particle size distribution of the original toner parent particles is not lost even following rounding, and small-diameter spherical toner having sharp particle size distribution can easily be obtained.

Regarding the softening agent used in the process for producing toner according to the present invention, a preferably used softening agent is an organic solvent which is liquid at room temperature, non-soluble in an aqueous disperse medium, capable of forming oil droplets in the aqueous disperse medium, and further capable of dissolving or swelling the binder resin in the toner parent particles. That is to say, when the toner parent particles absorb such a softening agent, the resin component comprising the toner parent particles softens, and the particles change into a true spherical form due to surface tension between the resin component and the aqueous disperse medium. Though the mechanism by which the softening agent is absorbed by the toner parent particles is not entirely known, the present inventors believe that this absorption occurs due to two mechanisms: a mechanism wherein the softening agent which has slightly dissolved in the disperse medium is diffused through the toner parent particles and thus absorbed, and a mechanism wherein the oil droplets of the softening agent in the disperse medium physically collide with the toner parent particles.

The aforementioned shape factor (SF-1) numerically represents the roundness of the toner particles, and is defined as described below.

A field-emission scanning electron microscope (FE-SEM) (e.g., "S-800", manufactured by Hitachi Ltd.) is used to randomly sample 100 toner particle images enlarged 500 to 2000 times in magnification, the image information thereof is introduced via an interface to an image analyzer (e.g., "Luzex III", manufactured by NIRECO K.K.), analysis is performed and calculated according to the following equation (A), and the obtained value is defined as the shape factor (SF-1).

$$\text{Shape factor } (SF-1) = \frac{(MXLNG)^2}{AREA} \times \frac{p}{4} \times 100 \quad \text{(A)}$$

wherein MXLNG represents the maximum diameter of the toner particles, and AREA represents the projected area of the toner particles.

Accordingly, in the event that the toner particles are true spheres, the shape factor (SF-1) is 100. In the event that the shape factor of toner particles formed by the melt-kneading/pulverizing method is calculated according to the above method, the shape factor (SF-1) generally exceeds 150, indicating that the form of pulverized toner is unstable.

With the present invention, pouring a parent particle disperse system into a softening agent disperse system prevents deterioration of particle size distribution. However, in the event that the speed of pouring is too slow, the difference between the time of starting and ending the pouring increases, thereby causing a difference in the amount of swelling of the parent particles, consequently worsening the particle size distribution of the spherical toner. Accordingly, the time from starting the introduction of the toner parent particles (a) to completing the introduction is preferably within one minute, more preferably within 30 seconds, and even more preferably within 10 seconds. However, in the event that too great an amount of the toner parent particle disperse system (a) is poured into the softening agent disperse system (b) at once, cohesion of the softening agent droplets and swollen parent particles occurs due to so-called solvent shock, consequently generating large particles. Specifically, the present inventors have discovered that such a problem hardly occurs in the event that the amount of disperse system (a) poured into the softening agent disperse system (b) in one second is 20% or less of the total amount of the softening agent disperse system (b). Accordingly, with the present invention, suitable conditions for introducing the disperse system (a) are that the time from starting the introduction of the disperse system (a) to completing the introduction is within one minute, and that the amount of disperse system (a) introduced in one second is 20% or less of the total amount of the disperse system (b). The above numerical values are calculated from the measured time from starting to ending of the introduction of the disperse system (a), the total amount of the introduction of the disperse system (a) and the total amount of the disperse system (b).

With the method for preparing toner according to the present invention, the amount of toner parent particles contained within the disperse system (a) at the time of adding the disperse system (a) to the disperse system (b) to prepare the mixed disperse system (c) is not particularly restricted. However, it is preferable that the amount of toner parent particles contained is 50% or less by weight as to 100 parts by weight of the total amount of the mixed disperse system (c), and more preferably 25% or less by weight. A larger percentage causes frequent cohesion between swollen particles, resulting in generation of large particles and broadening of particle size distribution.

Also, production efficiency is reduced in the event that the concentration of parent particles is too low, so the amount of toner parent particles to be added should preferably be adjusted so as to be 1.6% or more by weight of the total amount of the mixed disperse system (c). Further, in the event that the amount of toner parent particles to be added is 15% or more by weight, it is even more preferable that a later-described high polymer dispersant or inorganic solid dispersant be used in order to prevent coagulation between particles. These dispersants may be added to the toner parent particle disperse system (a) beforehand, or may be added to the mixed disperse system (c) following mixing of the disperse system (a) and the disperse system (b).

At the time of adding the disperse system (a) to the disperse system (b) to prepare the mixed disperse system (c), it is preferable that the amount of softening agent contained in the disperse system (b) be 1.0 part by weight to 20 parts by weight, based on 100 parts by weight of the total amount of the mixed disperse system (c), and more preferably 1.0 part by weight to 12 parts by weight. In the event that the amount of softening agent contained is less than 1.0 part by weight, emulsification is difficult, and in the event that the amount of softening agent exceeds 20 parts by weight, generation of large particles and broadening of particle size distribution tends to occur. Though the reason for this is not known, it is thought that the oil droplets tend to cohere one to another owing to increased density of the oil droplets, thus becoming unstable.

Further, with the present invention, at the time of adding the disperse system (a) having the toner parent particles to the disperse system (b) of oil droplets including the softening agent, the particular amount of softening agent per 100 parts by weight of the toner parent particles needs to be determined by the type and molecular weight of the binder resin comprising the toner parent particles, the type of softening agent and the like. However, for most purposes, this is preferably 2 to 1000 parts by weight, and, even more preferably, is 5 to 100 parts by weight. In the event that the ratio of softening agent per 100 parts by weight of the toner parent particles is less than 2 parts by weight, the toner parent particles cannot be swollen to the extent of becoming rounded, meaning that the toner parent particles may not completely become spherical in form. Conversely, in the event that this exceeds 1000 parts by weight, there are problems such as the toner parent particles adhering to one another, thereby generating large particles.

With the method for preparing toner according to the present invention, a preferable example is comprised such that the average particle diameter of the oil droplet particles contained in the disperse system (b) wherein oil droplets containing a softening agent are dispersed in an aqueous medium, is smaller than the average particle diameter of the toner parent particles contained in the disperse system (a) wherein toner parent particles are dispersed in an aqueous medium containing a dispersant.

In the event that the particle diameter of the oil droplet particles of softening agent are greater than the toner parent particles, problems may occur such as the oil droplets not being easily absorbed by the toner parent particles, or cohesion of swollen toner parent particles easily occurring, thereby broadening the particle size distribution. Further, it is believed that reducing the size of the softening agent oil droplets as much as possible and increasing the surface area thereof increases the dispersion speed of the softening agent and the speed of absorption. Accordingly, reducing the particle size of the oil droplet particles is an even more preferable condition. Incidentally, with the present invention, the particle diameter of the dispersed particles in the disperse system (a) and disperse system (b) can be obtained by optical microscope photography, for example.

Further, with the method for preparing toner according to the present invention, it is preferable that the number average particle diameter of the toner parent particles is 0.5 $\mu$m to 30 $\mu$m. That is to say, with the present invention, taking into consideration the final form of the toner, the dispersion stability of the particles in the aqueous medium, etc., it is preferable that the number average particle diameter of the toner parent particles used is 0.5 $\mu$m to 30 $\mu$m.

Further, with the method for preparing toner according to the present invention, it is preferable to use a softening agent such that the solubility of the softening agent in water at room temperature is within the range of $1\times10^{-6}$ to 10. More preferably, a softening agent is used with solubility within the range of $1\times10^{-5}$ to 5, and even more preferably, within the range of $1\times10^{-4}$ to 1. Here, solubility in water is the maximum mass of solute which can be dissolved in 100 g of water, represented in grams. The above term "room temperature" means 25° C.

Regarding the method for preparing toner according to the present invention, it is not clear why a softening agent having the above-described specific values for solubility in water is so effective. The present inventors theorize that where the solubility of the softening agent in water is less than $1\times10^{-6}$ too little softening agent is dissolved in the water, so not enough softening agent is absorbed by the toner parent particles to sufficiently obtain rounded toner particles. In the event that the solubility of the softening agent in water exceeds 10, the miscibility of the softening agent with water is too great, so the softening agent is not selectively absorbed by the toner parent particles, and consequently greater amounts of the softening agent may have to be added, or rounded toner may not be able to be obtained due to the binder resin component dissolving in the aqueous medium.

With the method for preparing toner according to the present invention, an arrangement wherein the toner parent particles have been produced by pulverizing is also a preferable example, in addition to the above arrangement. That is, the characteristic of the method for producing toner according to the present invention is that toner parent particles can be easily rounded. With the present invention, applying polymerization toner whereby spherical toner is generally obtained as the toner parent particles may have the effect of smoothing the roughness on the surface of the toner, but this is generally meaningless from the point of rounding to a sphere. Accordingly, with the present invention, the effects are manifested greater in arrangements wherein irregularly-shaped toner parent particles with a shape factor (SF-1) equal to or greater than 150 obtained by pulverization are used to obtain toner particles with a shape factor (SF-1) of 100 to 120 by means of rounding.

The following is a more detailed description of the present invention, giving preferred examples.

Methods for producing the toner parent particles for the present invention include: the pulverizing method wherein a binder resin, a coloring agent such as dye/pigment and/or a magnetic substance, wax, etc., are melt-kneaded, cooled, and the cooled kneaded material is pulverized, thereby obtaining toner; the suspension polymerizing method such as described in Japanese Patent Publication No. 36-10231, Japanese Patent Laid-Open No. 59-53856, and Japanese Patent Laid-Open No. 59-61842, the disclosure of which is incorporated by reference; toner producing methods using various types of polymerizing methods, such as the dispersion polymerizing method wherein a solvent is used in which monomers are soluble but polymers are non-soluble, or the emulsion polymerizing method wherein polymerization is performed in the presence of water-soluble polymerization initiator; a method described in Japanese Patent Publication No. 56-13945 wherein a disk or multi-fluid nozzle is used to mist a molten compound into the air, thereby obtaining toner, the disclosure of which is incorporated by reference; and all other known toner producing methods.

Further, if necessary, the toner parent particles used may be produced by one of the above toner producing methods and then classified or subjected to external additives so as to function as a toner.

The process for rounding the toner parent particles by the method for producing toner according to the present invention may be performed at any stage in the various toner preparing methods described above. Specifically, this may be performed at the following stages:

(1) Following the process of adding external additives.

(2) Between the process of classification and the process of adding external additives.

(3) Between the process of pulverizing and the process of classification.

(4) Following making the binder resin alone into powder of a size about 1 $\mu$m to 30 $\mu$m.

An example of suspension polymerization will be used to describe an example of the producing process, in the case of producing toner parent particles by the above-described polymerizing methods. First, a polymerizing monomer composition including polymerizing monomers, coloring agent, polymerization initiator, and other additives if necessary, is prepared. The prepared composition is introduced into an aqueous medium including a dispersant, and the polymerizing monomer composition is dispersed in a mixing apparatus such as a homogenizer or a homo-mixer, thereby forming particles. Subsequently, agitation is performed sufficiently to prevent the formed particles from sinking, and the polymerization reaction progresses. The polymerizing temperature is preferably within a range of 30° C. to 90° C., and more preferably between 40° C. to 80° C. The temperature may be raised at the latter half of the polymerization reaction, and further, part of the aqueous medium may be evaporated during the later half of reaction and/or following reaction, in order to remove unreacted polymerizing monomers and products. After the reaction is completed, the generated toner parent particles are recovered by washing and filtering, and then dried. Further, these may be classified if necessary, thereby obtaining toner parent particles having suitable grain size and particle size distribution.

Spherizing the toner parent particles obtained by polymerization as described above may be performed at any appropriate stage in toner production, as with the case of using pulverized particles. Specifically, this spherizing may be performed at the following stages:

(1) Following the process of adding external additives.

(2) Following the process of classification.

(3) Polymer particles are extracted from the polymer system and dried, following which the dried polymer particles are re-dispersed in an aqueous medium so as to form a disperse system, and at this point the rounding is conducted.

(4) Following completion of polymerization, and using the disperse liquid at the time of completion of polymerization as the disperse system.

With the present invention, examples of binder resin contained in the parent particles include: polystyrene; styrene derivative homopolymers such as poly-p-chlorostyrene and polyvinyl toluene; styrene copolymers such as styrene-p-chlorostyrene copolymers, styrene-vinyl toluene copolymers, styrene-vinyl naphthalene copolymers, styrene-ester acrylate copolymers, styrene-ester methacrylate copolymers, styrene-a-methyl chloromethacrylate copolymers, styrene-acrylonitrile copolymers, styrene-vinylmethylether copolymers, styrene-vinylethylether copolymers, styrene-vinylmethylketone copolymers, styrene-butadiene copolymers, styrene-isoprene copolymers, styrene-acrylonitrile-indenecopolymers; polyvinyl chloride; phenol resin; naturally denaturated phenol resin; naturally denaturated maleic acid resin; acrylic resin; methacrylic resin; polyvinyl acetate; silicone resin; polyester resin; polyurethane; polyamide resin; furan resin; epoxy resin; xylene resin; polyvinyl butyral; terpene resin; coumarone-indene resin; and petroleum resin. Particularly, cross-linked styrene copolymers and cross-linked polyester resins are preferable binder resins.

Examples of polymerizing monomers used in the case of producing toner parent particles by polymerization include: styrenes and their derivatives, such as styrene, poly-p-chlorostyrene, and polyvinyl toluene; double-bonded monocarboxylic acid and derivatives thereof, such as acrylic acid, methyl acrylate, ethyl acrylate, butyl acrylate, dodecyl acrylate, octyl acrylate, acrylic acid-2-ethylhexyl, phenyl acrylate, methacrylic acid, methyl methacrylate, ethyl methacrylate, butyl methacrylate, octyl methacrylate, acrylonitrile, methacrylonitrile, and acrylamide; double-bonded dicarboxylic acid and derivatives thereof, such as maleic acid, butyl maleate, methyl maleate, and dimethyl maleate; vinyl esters such as vinyl chloride, vinyl acetate, and vinyl benzoate; ethylene olefins such as ethylene, propylene, and butylene; vinyl ketones such as vinylmethyl ketone and vinylhexyl ketone; and vinyl ethers such as vinylmethyl ether, vinylethyl ether, and vinyl isobutyl ether. These vinyl monomers may either be used individually or as a combination of two or more. Particularly, a combination of styrene or a derivative thereof and double-bonded dicarboxylic acid or a derivative thereof is preferably used.

A compound having two or more double bonds capable of polymerizing is used for the cross-linking agent. Examples include: aromatic divinyl compounds, such as divinyl benzene and divinyl naphthalene; carboxylic acid ester having two double bonds, such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds with three or more vinyl groups. These may be used either individually or as mixtures.

With the present invention, in the case of using a styrene-acrylic copolymer as the binder resin, it is preferable to use a binder resin which has at least one peak in the molecular weight range of 3,000 to 50,000 according to THF (tetrahydrofuran)-soluble Gel Permeation Chromatography (GPC), and which is comprised 50% to 90% of a component with molecular weight of 100,000 or less.

With the present invention, the molecular weight distribution of the soluble portion of the binder resin according to GPC with THF as a solvent is measured under the following conditions, with measurement being made for molecular weights of 1000 and above.

Columns are stabilized in a 40° C. heat chamber, with THF serving as a solvent flowing into the columns at this temperature at a flow of 1 ml per minute, and approximately 100 $\mu$l of a THF sample solution is injected and measured. Regarding measurement of the molecular weight of the sample, the molecular weight distribution of the sample is calculated from the relation between the logarithm value and count value of an analytical curve created by several types of monodisperse polystyrene reference samples. As for the reference polystyrene samples used for creating the analytical curve, at least 10 or so reference polystyrene samples, such as those manufactured by Toso or Showa Denko K.K. with molecular weight of $10^2$ to $10^7$, should be used. Also, an RI (refraction index) detector is used for the detector. Incidentally, a preferable arrangement for the columns is to combine a plurality of commercially-available polystyrene gel columns, examples including combinations of shodex GPC KF-801, 802, 803, 804, 805, 806, 807, and 800P, manufactured by Showa Denko K.K., and combinations of TSKgel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$), and TSKgurd column, manufactured by Tosoh Corporation.

The amount of inclusion of components with molecular weight of 100,000 or less is obtained from the molecular weight distribution according to GPC obtained by the above method, by calculating the ratio of the molecular weight integration value of molecular weight of 100,000 or less as to the molecular weight integration value of molecular weight of 1000 or more.

The sample is prepared as follows. The sample is placed in the THF, left standing for several hours, then sufficiently shaken and mixed with the THF (until there are no composite bodies of the sample), and further left undisturbed for 12 hours or more. At this time, the amount of time the sample is left standing in the THF is 24 hours or longer. Subsequently, this is passed through a sample processing filter (with a bore size 0.2 to 0.5 $\mu$m; e.g., MAISHORI DISK H-25-2 (manufactured by Tosoh corporation) or the like may be used), and used as the sample for GPC. Also, the sample concentration is adjusted so that the resin component is 0.5 to 5 mg/ml.

With the method for producing toner according to the present invention, the polyester resin shown below may be used as the binder resin. A preferably used polyester resin has 45 to 55 mol % alcohol component based on a total of all the components, and 55 to 45 mol % acid component.

Examples of polyhydric alcohol for the alcohol component include: diols such as ethylene glycol, propylene glycol, 1,3-butandiol, 1,4-butandiol, 2,3-butandiol, diethyleneglycol, triethylene glycol, 1,5-pentandiol, 1,6-hexandiol, neopentyl glycol, 2-ethyl-1,3-hexanediol, bisphenol A hydride, bisphenol derivatives shown in Formula (B), and diols shown in Formula (C); glycerines; sorbitol; and sorbitan.

(B)

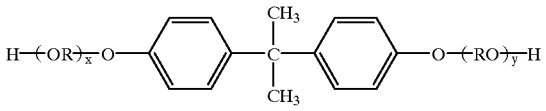

wherein R represents ethylene or propylene groups, x and y each represents an integer of 1 or greater, and the average of x+y is between 2 to 10.

(C)

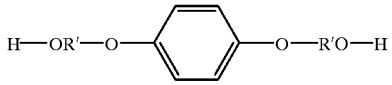

wherein R' represents —$CH_2CH_2$—,

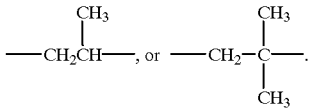

Specific examples of dibasic carboxylic acid comprising 50 mol % or greater of all acid components include: benzene dicarboxylic acids or anhydrides thereof, such as phthalic acid, terephthalic acid, isophthalic acid, and phthalic anhydride; alkyl dicarboxylic acids and anhydrides thereof, such as succinic acid, adipic acid, sebacic acid, azelaic acid; succinic acid substituted by an alkyl group or alkenyl group having 6 to 18 carbon atoms, or anhydrides thereof; and unsaturated dicarboxylic acids or anhydrides thereof, such as fumaric acid, maleic acid, citraconic acid, and itaconic acid. Examples of tribasic or higher carboxylic acids include trimellitic acid, pyromellitic acid, benzophenone tetracarboxylic acid, and anhydrides thereof.

A polyester resin suitably used with the method for producing toner according to the present invention has an acid value preferably 90 mgKOH/g or lower, and even more preferably 50 mgKOH/g or lower. This is due to the fact that the environmental stability of the charging properties of the toner may become unstable in the event that the number of terminal groups on the molecule chain increases.

The acid value of the polyester resin is measured by the following measurement method. The acid value is defined as the number of milligrams of caustic potash necessary to neutralize the carboxyl groups contained in one gram of resin. Accordingly, the acid value represents the number of terminal groups. The measurement method is as follows.

2 to 10 grams of a sample is measured into a 200 to 300 ml conical flask, and approximately 50 ml of a mixed solvent comprised of methanol and toluene at a ratio of 30 to 70 is added, thereby dissolving the resin. In the event that the resin does not dissolve well, a small amount of acetone may be added. Titration is performed with a standardized N/10 caustic potash—alcohol solution, using 0.1% of a mixed indicator comprised of bromothymol blue and phenol red, and the acid value is calculated from the amount of alcohol-potash liquid consumed, using the following expression:

$$\text{Acid value (mgKOH/g)}=\{\text{KOH (number of ml)}\times N\times 56.1\}/\text{amount of sample}$$

wherein N is a factor of N/10 KOH.

In the event of using polyester resin as the binder resin, the number average molecular weight is preferably between 3,000 to 100,000, and the weight average molecular weight is preferably between 5,000 to 500,000.

Further, with the present invention, it is preferable that the glass transition temperature (Tg) of the binder resin be between 0° C. to 150° C., more preferably between 30 to 100° C., and even more preferably between 50 to 90° C.

In the event that the Tg of the binder resin is below 0° C., the anti-blocking properties of the toner deteriorates, and in the event that the Tg of the binder resin exceeds 150° C., the temperature at which fixing can occur becomes undesirably high.

The glass transition temperature of the binder resin is measured according to the following measuring method. Measurement is made using a differential scanning calorimeter (DSC measurement apparatus) DSC-7 (manufactured by Parkin Elmer Corp.), in accordance with ASTM D3418-82.

5 to 20 mg of measurement sample, preferable 10 mg, is precisely measured. This is placed in an aluminum pan, and using an empty aluminum pan as reference, measurement is made under the conditions of measurement temperature range of 30 to 200° C., temperature increase rate of 10° C./min, and of normal temperature and normal humidity. The endothermic peak of the main peak obtained is in the range of 40 to 100° C. during this temperature rise. The glass transfer point Tg in the present invention is defined by the intersection between: the line of the central point between the base lines before and after this endothermic peak is detected; and the differential thermal curve.

Regarding the coloring agents used in the method for preparing toner according to the present invention, a black coloring agent may be carbon black, a magnetic substance, the following yellow/magenta/cyan coloring agents toned to black, or the following yellow, magenta, and cyan colors used individually.

Suitably used for the yellow coloring agents are compounds represented by condensation azo compounds, isoindolinone compounds, anthraquinone compounds, azo metal complexes, methine compounds, arylamide compounds. Specific examples include C. I. Pigment Yellow 12, 13, 14, 15, 17, 62, 74, 83, 93, 94, 95, 97, 109, 110, 111, 120, 127, 128, 129, 147, 168, 174, 176, 180, 181, and 191.

Suitably used for the magenta coloring agents are condensation azo compounds, diketopyrrolopyrrole compounds, anthraquinone compounds, quinacridone compounds, base dye lake compounds, naphthol compounds, benzimidazolone compounds, thioindigo compounds, and perylene compounds. Specific examples include C. I. Pigment Red 2, 3, 5, 6, 7, 23, 48:2, 48:3, 48:4, 57:1, 81:1, 1, 144, 146, 166, 169, 177, 184, 185, 202, 206, 220, 221, and 254.

Suitably used for the cyan coloring agents are copper phthalocyanine compounds and derivatives thereof, anthraquinone compounds, base dye lake compounds, and the like. Specific examples include C. I. Pigment Blue 1, 7, 15, 15:1, 15:2, 15:3, 15:4, 60, 62, and 66.

These coloring agents may be used either individually or mixed, and further may be used in a solid solution state.

It is preferable that the amount of coloring agent included in the toner parent particles be between 40 to 150 parts by weight to 100 parts by weight of binder resin in the case that a magnetic substance is used. It is also preferred that the amount of coloring agent included in the toner parent particles be between 5 to 20 parts by weight to 100 parts by weight in the event that other coloring agents are used.

With the method for producing toner according to the present invention, magnetic toner containing magnetic materials can be obtained. The magnetic material used in this case may also serve as a coloring agent. Examples of magnetic materials (magnetic substances) which can be used for the toner according to the present intention include: iron oxides such as magnetite, hematite, and ferrite; magnetic metals such as iron, cobalt, and nickel; and alloys of these with non-magnetic metals such as aluminum, cobalt, copper, lead, magnesium, tin, zinc, antimony, beryllium, bismuth, cadmium, calcium, manganese, selenium, titanium, tungsten, vanadium, and mixtures thereof.

With the method for producing toner according to the present invention, a magnetic substance with surface reforming is even more preferably used. Particularly, in the event of producing toner parent particles by polymerization, a magnetic substance which has been subjected to hydrophobic treatment by a surface treating agent which does not interfere with the polymerization is preferably used. Examples of such surface treating agents include silane coupling agents and titanium coupling agents. Further, it is preferable that the number average particle diameter of the magnetic substance be 1 $\mu$m or less, and more preferably between 0.1 $\mu$m and 0.5 $\mu$m. Further, it is preferable that the magnetic properties of the magnetic substance under an external magnetic field of 795.8 KA/m (10K oersted) be: coercive force ($H_c$) of 20 to 300 oersted, saturation magnetization ($s_s$) of 50 to 200 emu/g, and residual magnetization ($s_r$) of 2 to 20 emu/g.

The average particle diameter by number of the magnetic substance can be measured with a transmission electron microscope by randomly selecting 300 magnetic substance particles from a photograph taken at magnification of 40,000 times and enlarged, and measuring these with a digitizer. The magnetic properties of the magnetic substance are values measured under an external magnetic field of 795.8 KA/m using a "vibrating sample magnetometer VSM-3S-15" manufactured by Toei Kogyo K.K.

Regarding the softener used with the method for producing toner according to the present invention, any organic compound capable of softening the binder resin component comprising the toner parent particles may be used, but a softener with little solubility in water is preferably used. Accordingly, the softener usable with the method for producing toner according to the present invention is determined by the binder resin component comprising the toner. Whether or not a certain compound is capable of softening the binder resin component comprising the toner parent particles can be determined by the following method, for example.

With this method, 10 g of toner parent particles used in the rounding process in the method for producing toner according to the present invention is measured into a 50 ml sample bottle, to which is added 20 g of the organic compound to be used as a softener and agitated for around 2 minutes, following which this combination is left standing for a full day. Then, the state of the particle sample is observed. In the event that the particles are dissolved and/or swollen, or deformed, it can be determined that this compound softens the binder resin component comprising the toner parent particles.

The softener used with the present invention may be appropriately selected according to the binder resin component comprising the toner parent particles by the above-described method or the like. Specific examples of softener include: long-chain alcohols such as 3-pentanol, 2-methyl-1-butanol, isopentyl alcohol, tert-pentyl alcohol, 1-hexanol, 2-methyl-1-pentanol, 4-methyl-2-pentanol, 2-ethyl butanol, 1-heptanol, 2-heptanol, 3-heptanol, 2-octanol, and 2-ethyl-1-hexanol; alkylester acetates such as ethyl acetate, butyl acetate, isobutyl acetate, isopropyl acetate, and isoamyl acetate; ester acetates such as cresyl acetate, cyclohexyl acetate, phenyl acetate, naphthyl acetate, and benzyl acetate; ketones such as diethyl phthalate, dioctyl phthalate, didodecyl phthalate, dibutyl phthalate, and dimethyl phthalate; aliphatic or aromatic hydrocarbons such as pentane, 2-methyl butane, n-hexane, cyclohexane, 2-methyl pentane, 2,2-dimethyl butane, 2,3-dimethyl butane, heptane, n-octane, isooctane, 2,2,3-trimethyl pentane, decane, nonane, cyclopentane, methyl cyclopentane, methyl cyclohexane, ethyl cyclohexane, p-menthane, bicyclohexyl, benzene, toluene, xylene, and ethyl benzene; halogenated hydrocarbons such as carbon tetrachloride, chloroform, dichloromethane, dichloroethane, trichloroethane, chlorobenzene, dichlorobenzene, and tetrabromoethane; and sulfur-containing or nitrogen-containing organic compounds such as nitropropene, nitrobenzene, dimethyl formamide, and dimethyl sulfoxide. These compounds may be used individually or mixed.

Though the main component of the aqueous medium used with the method for producing toner according to the present invention is water, 30% by weight or less of a hydrophilic organic solvent may be mixed with the water to form a mixed solvent, in order to appropriately adjust the solubility of the above softeners in the aqueous solution. Further, with the present invention, it is preferable to use an aqueous medium wherein the ratio of water is 300 to 3000 parts by weight as to 100 parts by weight of toner parent particles.

In the process (1) for preparing the disperse system (a) and process (2) for preparing the disperse system (b), using the aqueous medium described above, it is important that the disperse systems have the toner parent particles and softeners sufficiently dispersed. To this end, mechanical mixers such as homogenizers or homo-mixers, or ultrasonic dispersing apparatuses such as ultrasonic homogenizers are preferably used to sufficiently stir and disperse.

Further, with the method for producing toner according to the present invention, organic or inorganic dispersants can be used to suitably disperse the toner parent particles and softener droplets. Any known dispersant may be used. Examples of organic dispersants include polyvinyl alcohol, polyvinyl methylether, polyvinyl ethylether, polyvinyl pyrrolidone, polyethylene oxide, gelatine, methyl cellulose, methylhydroxypropyl cellulose, ethyl cellulose, sodium salts of carboxymethyl cellulose, and starch. Examples of inorganic dispersants include tribasic calcium phosphate, magnesium phosphate, aluminum phosphate, zinc phosphate, calcium meta-silicic acid, calciumsulfate, bariumsulfate, bentonite, silica, and alumina. Particularly preferable with the present invention is an inorganic dispersant which is not easily soluble in water, such as the above inorganic oxides not easily soluble in water, but soluble in acid. The above dispersants are preferably used in a range of 0.01 to 5.0 parts by weight to 100 parts by weight of toner parent particles.

Further, in order to improve the dispersability of these dispersants, surface active agents may be used in a range of 0.001 to 0.1 part by weight to 100 parts by weight of toner parent particles.

Examples of surface active agents which may be used include commercially-available nonionic, anionic, and cationic surface active agents. Specific examples include sodium dodecyl sulfate, sodium tetradecyl sulfate, sodium pentadecyl sulfate, sodium octyl sulfate, sodium oleate, sodium laurate, potassium stearate, calcium oleate, and mixtures thereof. These may be used individually or as a mixture.

The inorganic dispersants which are not easily soluble in water may be used as commercially obtained, or may be generated by mixing at high speeds in a disperse medium, in order to obtain dispersant particles with fine and uniform grain size. For example, tribasic calcium phosphate may be mixed with a sodium phosphate aqueous solution and a calcium chloride aqueous solution by stirring at high speed, thereby obtaining a suitable dispersant.

With the method for producing toner according to the present invention, in the process (3) for preparing a mixed disperse system (c) by adding the disperse system (a) to the disperse system (b), and causing the softening agent to be absorbed by the toner parent particles in the mixed disperse system (c), it is preferable that stirring be performed at least to a degree that the toner parent particles do not settle out. The suitable stirring speed at this time depends on the size of the system, the concentration of the toner parent particles, and so forth, but speeds either too slow or too fast bring about cohesion, resulting in larger particles. Further, heating or cooling may be performed along with the stirring in order to adjust the absorption speed. In the case of heating, the temperature should preferably be equal to or lower than the glass transition temperature (Tg) of the binder resin comprising the toner parent particles. In the case of cooling, the temperature should preferably be equal to or higher than 0° C.

With the method for producing toner according to the present invention, in the process (4) for removing the softening agent, the softening agent may be removed from the parent particles by heating the disperse system, stirring at room temperature, or depressurizing. Further, the softening agent may be removed by washing with a solvent which has the property of dissolving the solvent, but not the toner components. Moreover, such methods may be combined. Specific examples of solvents having the above properties include methanol, ethanol, propanol, acetone, dimethylethyl, diethylether, and ethylmethylether.

With the method for producing toner according to the present invention, a charge controlling agent may be included in the toner in order to stabilize the friction charge properties of the obtained toner. In this case, a charge controlling agent capable of providing the toner with a fast charging speed and a constant charge amount is preferable. Examples of negative charge controlling agents include: organometallic compounds such as organometallic complexes or chelate compounds of aromatic hydroxycarboxy acids, such as salicylic acid, alkylsalicylic acid, dialkylsalicylic acid, naphthoic acid, and dicarboxylic acid. Other examples include sulfonic acid, polymer-type compounds with carboxylic acid as side chains, boron compounds, carbamide compounds, silicone compounds, and calixarenes. Examples of positive charge controlling agents include: quaternary ammonium salts, polymer-type compounds with the quaternary ammonium salts as side chains, guanidine compounds, and imidazole compounds. The charge controlling agents are preferably included in the toner parent particles at a ratio of 0.5 to 10 parts by weight per 100 parts by weight of binder resin.

Further, with the present invention, various conventional additives as described below may be used to provide the toner with various properties.

Specifically, examples of flowability improving agents include inorganic oxides (silicon oxide, aluminum oxide, and titanium oxide), carbon black, and carbon fluoride.

Preferably, these have been subjected to hydrophobic treatment. Suitably used polishing agents include metal oxides (strontium titanate, ceric oxide, aluminum oxide, magnesium oxide, and chromium oxide), nitrides (silicon nitride), carbides (silicon carbide), and metal salts (calcium sulfate, barium sulfate, and calcium carbonate) Suitably used lubricants include fluorine resin powders (polyvinylidene fluoride and polytetrafluoroethylene), and fatty acid metal salts (zinc stearate and calcium stearate). Suitably used charge controlling particles include metal oxides (tin oxide, titanium oxide, zinc oxide, silicon oxide, and aluminum oxide) and carbon black.

These additives are preferably used within a range of 0.1 to 10 parts by weight to 100 parts by weight of toner parent particles, and more preferably used within a range of 0.1 to 5 parts by weight. The additives may be used individually, or multiple additives may be used concurrently.

With the present invention, external adding of inorganic oxide fine powder, such as silica, to the toner particles is particularly preferable. Suitably used inorganic oxide fine powder preferably has a specific surface area of 30 $m^2/g$ or greater according to nitrogen attachment as measured with the BET method, and more preferably, of 60 to 400 $m^2/g$.

The specific surface area of the inorganic oxide fine powder is measured according to the BET method, using specific surface area measuring equipment, an AUTOTHOPE 1 (manufactured by Yuasa Ionics K.K.), to attach nitrogen gas to the surface of the sample, and the specific surface area is measured using the BET multi-point method.

The toner particles produced by the producing method according to the present invention preferably have a number average particle diameter of 0.3 to 20 $\mu$m, and more preferably 5 to 10 $\mu$m. The amount of toner particles with particle diameters 10 $\mu$m or greater is preferably 10% by number or less, and more preferably 5% by number or less. In the event that the number average particle diameter is less than 0.3 $\mu$m, the powder becomes extremely difficult to handle, and in the event that the number average particle diameter exceeds 20 $\mu$m, dot reproducibility on the photosensitive member deteriorates. In the event that the amount of toner particles with particle diameters 10 $\mu$m or greater exceeds 10% by number, there may be problems such as scattering or deterioration of dot reproducibility.

The toner particles produced by the above producing method may be used as is as a one-component developer following external addition of external additives, or may be mixed with a carrier and used as a two-component developer.

As described above, according to the present invention, a process for producing toner can be provided whereby spherical toner can easily be obtained by means of rounding or spherizing toner parent particles, without being restricted by the binder resin components comprising the toner or the producing method thereof, and without using significant amounts of energy. Further, according to the present invention, an excellent process for producing toner can be provided, wherein despite the toner parent particles having been subjected to rounding, the sharp particle size distribution of the obtained toner particles is not lost, and large particles do not form.

The following is an even more specific description of the present invention with Examples and Comparative Examples, but it should be noted that the present invention is by no means restricted to these Examples.

EXAMPLE 1

Toner particles were produced by initially providing toner parent particles having the following ingredients:

| | |
|---|---|
| Polyester resin (weight average molecular weight of 90,000, number average molecular weight of 4000, acid value of 8 mg KOH/g, Tg = 65° C.) obtained by condensation polymerization of polyoxypropylene(2,2)-2, 2-bis(4-hydroxyphenyl) propane, fumaric acid, and 1,2,5-hexanetricarboxylic acid | 100 parts by weight |
| Phthalocyanine pigment (C. I. Pigment Blue 15:3) | 5 parts by weight |
| Chromium complex of di-ter-butylsalicylic acid | 4 parts by weight |

The above ingredients were subjected to sufficient premixing with a Henschel mixer, then subjected to melt-kneading at 140° C. with a twin-screw extrusion kneader, cooled, pulverized to around 1 to 2 mm with a hammer mill, and then finely pulverized with a fine pulverizer by the air jet method. Further, the obtained finely pulverized material was classified, thereby obtaining cyan-colored toner parent particles 1.

Measurement of the shape factor (SF-1) of the toner parent particles 1 showed the SF-1 value to be 156, and the particles to be irregular in shape. An electronic microscope photograph taken at 1,000 times magnification was enlarged to 200% using a Canon full-color photocopier CLC700, the particle diameter in the direction of a toner parent particle at right angles with the direction thereof which is the longest particle diameter was measured as the particle diameter. This operation was repeated for 200 toner parent particles, and the results were averaged so as to obtain the average particle diameter of this toner. As a result, the number average particle diameter of the toner parent particles was 6.2 $\mu$m. Further, the amount of toner parent particles contained with a particle diameter of 10 $\mu$m or greater was 2.3% by number.

Testing for a softener according to the above-described method in order to identify a softener to be used for this toner parent particle 1 showed that the toner parent particle 1 is softened by isoamyl acetate. Accordingly, the toner parent particle 1 was subjected to rounding by the following method, using isoamyl acetate as the softening agent.

First, 18 parts by weight of the above obtained toner parent particles were added to 100 parts by weight of a 0.5% by weight aqueous solution of sodium dodecylbenzene sulfonate. These ingredients were stirred well, and further the toner parent particles 1 were sufficiently dispersed using an ultrasonic dispersing apparatus, thereby forming a disperse system -1(a).

Next, 4 parts by weight of isoamyl acetate were added to 1000 parts by weight of a 0.3% by weight aqueous solution of sodium dodecyl sulfonate and then dispersed by ultrasound for 10 minutes using an ultrasonic dispersing apparatus, thereby forming a disperse system -1(b), wherein oil droplets containing isoamyl acetate were dispersed.

Now, sampling 0.5 parts by weight each of the disperse system -1(a) and disperse system -1(b) and observing the dispersion state with an optical microscope revealed that the dispersed particles in the disperse system -1(b) were smaller than those in the disperse system -1(a).

Next, 1000 parts by weight of the disperse system -1(b) obtained above were stirred at a rotation speed of 200 rpm, and at this time 110 parts by weight of the disperse system -1(a) were mixed in over a period of 3 seconds, thereby forming a disperse system -1(c). The disperse system -1(a) was mixed in over a period of 3 seconds, so the amount of disperse system -1(a) mixed in per second was 37 parts by weight. Accordingly, approximately 4% by weight of disperse system -1(a) was mixed in per second as to the total amount of the disperse system -1(b). Observing the disperse system -1(c) with an optical microscope revealed that the liquid droplets observed in the disperse system -1(b) had disappeared, and that the cyan-colored toner parent particles 1 observed in the disperse system -1(a) had absorbed the isoamyl acetate and reformed into spherical forms.

Next, this disperse system -1(c) was depressurized for 15 hours using a water flow pump, thereby removing the isoamyl acetate from the toner parent particles 1. Subsequently, washing and filtering were repeated 3 times, thereby obtaining spherical cyan toner particles (1).

Measurement of the obtained spherical cyan toner particles (1) revealed the shape factor (SF-1) to be 104, which is almost a true sphere. Further, the number average particle diameter of the spherical cyan toner particles (1) measured according to the same method as above was 6.4 $\mu$m, the amount of toner parent particles contained with a particle diameter of 10 $\mu$m or greater was 2.5% by number, so neither number average particle diameter nor particle size distribution were lost.

Next, 98 parts by weight of the cyan toner particles (1) and 2 parts by weight of a hydrophobic titanium oxide powder (BET specific surface area of 140m$^2$/g) were mixed, thereby preparing a cyan toner (1).

Further, 5 parts by weight of the above cyan toner (1) and 95 parts by weight of coated magnetic ferrite carrier (average particle diameter 45 $\mu$m) formed by coating silicone resin with 1% by weight were mixed, thus preparing a two-component developer. The two-component developer thus obtained was introduced into a full color photocopier (CLC-800, manufactured by Canon K.K.), and an image was formed in the monocolor mode with the contrast potential at 250V, resulting in a good image being obtained.

EXAMPLE 2

Toner particles were produced by initially providing toner parent particles having the following ingredients:

| | |
|---|---|
| Styrene-butylacrylate-monoethylester of maleic acid copolymer (weight average molecular weight of 180,000, number average molecular weight of 12,000, Tg = 65° C.) | 100 parts by weight |
| Magenta pigment (C. I. Pigment Red 122) | 4 parts by weight |
| Di-tert-butylsalicylic acid | 2 parts by weight |

The above ingredients were used, and with the same method as Example 1, magenta toner parent particles 2 with an average particle diameter of 7.2 $\mu$m were obtained. The amount contained of particles 10 $\mu$m or greater in the toner parent particles 2 was 8.3% by number. Measurement of the shape factor (SF-1) of the toner parent particles 2 showed the SF-1 value to be 158, and the particles to be irregular in shape. Further, a softening agent test showed the toner parent particles 2 to be softened by isoamyl acetate. Hence, isoamyl acetate was used as the softener, and the toner parent particles 2 were formed into spherical forms by the following method.

The same process as Example 1 was performed except for using the toner parent particles 2 instead of the toner parent particles 1, and using 16 parts by weight of isoamyl acetate instead of 4 parts by weight, thereby preparing a disperse system -2(a) containing the toner parent particles, and a disperse system -2(b) wherein oil droplets containing isoamyl acetate were dispersed. Sampling 0.5 parts by weight each of the disperse system -2(a) and disperse system -2(b) revealed that the dispersed particles in the disperse system -2(b) were smaller than those in the disperse system -2(a).

Next, in the same manner as Example 1, 110 parts by weight of the disperse system -2(a) were added to 1000 parts by weight of the disperse system -2(b) over a period of 3 seconds, thereby forming a disperse system -2(c), whereby the isoamyl acetate was absorbed by the toner parent particles 2. In this case, the disperse system -2(a) was mixed in over a period of 3 seconds, so the amount of disperse system -2(a) mixed in per second was 37 parts by weight, so approximately 4% by weight of disperse system -2(a) was mixed in per second as to the total amount of the disperse system -2(b). Next, the disperse system -2(c) was placed in large amounts of ethanol, thus removing the isoamyl acetate from the toner parent particles 2. Subsequently, washing and filtering were repeated, thereby obtaining spherical magenta toner particles (2).

Measurement of the obtained spherical magenta toner particles (2) revealed the shape factor (SF-1) to be 105, which is almost a true sphere. Further, the number average particle diameter of the spherical magenta toner particles (2) according to the same method as above was 7.5 $\mu$m, and the amount of toner parent particles contained with a particle diameter of 10 $\mu$m or greater was 8.9% by number, so neither number average particle diameter nor particle size distribution were lost.

Further, 98 parts by weight of the magenta toner particles (2) and 2 parts by weight of a hydrophobic titanium oxide powder (BET specific surface area of 140m$^2$/g) were mixed, thereby preparing a magenta toner (2). 5 parts by weight of the magenta toner (2) and 95 parts by weight of coated magnetic ferrite carrier (average particle diameter 45 $\mu$m) formed by coating silicone resin with 1% by weight were mixed, thus preparing a two-component developer. The two-component developer thus obtained was introduced into a full color photocopier (CLC-800, manufactured by Canon K.K.), and an image was formed in the monocolor mode with the contrast potential at 250V, resulting in a good image being obtained.

EXAMPLE 3

Toner particles were formed as in Example 1 from toner parent particles having the following ingredients:

| | |
|---|---|
| Styrene-butylacrylate-monoethylester of maleic acid copolymer (weight average molecular weight of 180,000, number average molecular weight of 12,000, main peak at molecular weight of 4,000) | 100 parts by weight |
| Magnetic iron oxide (average particle diameter by number 0.18 $\mu$m, and the following properties under an external magnetic field of 795.8 KA/m: $H_c$ of 121 oersted, $s_c$ of 83 emu/g, and $s_r$ of 11 emu/g) | 80 parts by weight |
| Low-molecular weight propylene-ethylene copolymer | 3 parts by weight |
| Chromium complex of di-tert-butylsalicylic acid | 1 part by weight |

The above ingredients were subjected to sufficient premixing with a Henschel mixer, then subjected to melt-kneading at 140° C. with a twin-screw extrusion kneader, cooled, coarsely pulverized with a cutter mill, and then pulverized with a fine pulverizer by the air jet method. Further, the obtained pulverized material was classified with a pneumatic classifier, thereby obtaining magnetic toner parent particles 3 with a negative charge of a number average particle diameter of 8.3 $\mu$m. The amount of the obtained toner parent particles contained therein with a particle diameter of 10 μm or greater was 9.1% by number. Measurement of the shape factor (SF-1) of the toner parent particles 3 showed the SF-1 value to be 164, and the particles to be irregular in shape. Further, testing for a softener showed that the toner parent particles 3 are softened by toluene. Accordingly, the toner parent particles 3 were subjected to rounding with the following method, using toluene as the softening agent.

First, 200 parts by weight of the above obtained toner parent particles 3 were added to 100 parts by weight of a 1% by weight aqueous solution of polyvinyl alcohol; these ingredients were stirred well, and, further, the toner parent particles 3 were sufficiently dispersed using an ultrasonic dispersing apparatus, thereby forming a disperse system -3(a).

Next, 200 parts by weight of acetone were added to 600 parts by weight of a 0.3% by weight aqueous solution of sodium dodecyl sulfonate, then dispersed by ultrasound for 18 minutes using an ultrasonic dispersing apparatus, thereby forming a disperse system -3(b) wherein oil droplets containing toluene were dispersed.

Next, by, sampling 0.5 part by weight each of the disperse system -3(a) and disperse system -3(b) and observing the dispersion state with an optical microscope it was revealed that the dispersed particles in the disperse system -3(b) were smaller than those in the disperse system -3(a).

Next, 780 parts by weight of the disperse system -3(b) obtained above were stirred at a rotation speed of 320 rpm, and at this time 280 parts by weight of the disperse system -3(a) were mixed in over a period of 5 seconds, thereby forming a disperse system -3(c). In this case, the disperse system -3(a) was mixed in over a period of 5 seconds, so the amount of disperse system -3(a) mixed in per second was 56 parts by weight, so approximately 7% by weight of disperse system -3(a) was mixed in per second to the total amount of the disperse system -3(b). Further, observing the disperse system -3(c) with an optical microscope revealed that disperse particles having the particle diameters of the disperse system -3(a) and disperse system -3(b) were coexisting. This system was further stirred at 320 rpm for 6 hours at 25° C., following which observing the disperse system -3(c) with an optical microscope revealed that the toner parent particles 3 had absorbed the acetone and reformed into spherical forms. Further, the reacting container was heated to 50° C., thereby extracting and removing the toluene from the toner parent particles 3. Subsequently, washing and filtering were repeated, following which drying obtained spherical black toner particles (3).

Measurement of the obtained spherical black toner particles (3) revealed the shape factor (SF-1) to be 112, which is almost a true sphere. Further, the number average particle diameter of the spherical black toner particles (3) according to the same method as in Example 1 was 8.7 μm, and the amount of toner parent particles contained therein with a particle diameter of 10 μm or greater was 9.5% by number, so neither number average particle diameter nor particle size distribution were lost.

Next, 100 parts by weight of the black toner particles (3) and 0.4 parts by weight of a hydrophobic dry silica (BET 200m$^2$/g) were combined, and sufficiently mixed in a Henschel mixer, thereby preparing a black toner (3). The black toner (3) thus obtained was mounted in an NP-8580 copier (manufactured by Canon K.K.), and an image was formed, resulting in a good image being obtained.

EXAMPLE 4

Placed inside a reacting container were 650 parts by weight of ion-exchanged water, and 510 parts by weight of an aqueous solution of 0.1M—$Na_3PO_4$. The contents were heated to 60° C., and stirred at a rotation speed of 12,000 rpm, using a TK type homo-mixer (manufactured by TOKUSHUKIKA KOGYO K.K. 75 parts by weight of an aqueous solution of 0.1M—$CaCl_2$ was slowly added to this solution, thereby forming an aqueous medium containing $Ca_3(PO_4)_2$ of a fine and uniform particle size.

The following ingredients were admixed:

| | |
|---|---|
| Styrene | 200 parts by weight |
| n-butyl acrylate | 50 parts by weight |
| Phthalocyanine pigment (C. I. Pigment Blue 15:3) | 5 parts by weight |
| Styrene-methacrylate copolymer (weight average molecular weight of 240,000, monomer weight ratio of 90:10) | 6 parts by weight |
| Chromium complex of di-tert-butylsalicylic acid | 2 parts by weight |

The above mixed materials were heated to 60° C., and stirred at a rotation speed of 12,000 rpm, using a TK type homo-mixer, there by uniformly dissolving and dispersing the ingredients. In this mix were dissolved 8 parts by weight of a polymerization initiator 2,2'-azo bis(2,4-dimethyl valeronitrile), thereby preparing a polymerizing monomer composition.

The polymerizing monomer composition prepared above was placed inside the aqueous medium prepared above, and was stirred at 12,000 rpm for 20 minutes using a TK type homo-mixer, at a temperature of 60° C. and in a nitrogen atmosphere, thereby uniformly dispersing the polymerizing monomer composition in the aqueous medium, and forming particles. Subsequently, polymerization was allowed to take place for 20 hours while stirring with paddles, thereby synthesizing toner parent particles 4.

Following completion of polymerization, 0.5 part by weight of the dispersant in which the toner parent particles 4 are dispersed was sampled, dilute sulfuric acid was added and calcium phosphate was dissolved, after which filtering, washing and drying was performed, thus extracting the toner parent particles 4 from the disperse liquid. Measurement of the shape factor (SF-1) of the toner parent particles 4 showed the SF-1 value to be 122. The number average particle diameter of the toner parent particles 4 according to the same method as Example 1 was 5.0 μm, and the amount contained of particles 10 μm or greater was 0.5% by number.

On the other hand, 100 parts by weight of chloroform serving as a softener were added to 400 parts by weight of a 0.3% by weight aqueous solution of sodium dodecyl sulfonate, then dispersed by ultrasound for 12 minutes using an ultrasonic dispersing apparatus, thereby forming a disperse system -4(b). Sampling 0.5 part by weight of the disperse system -4(b) and disperse system -4(a) and comparing the particle diameter in the same manner as Example 1 revealed that the dispersed particles in the disperse system -4(b) were smaller.

Next, 1580 parts by weight of the solution left over from sampling following the completion of the polymerization reaction were used as a disperse system -4(a), added to 480 parts by weight of the disperse system -4(b) being stirred at a rotation speed of 200 rpm over a period of 20 seconds, thereby forming a disperse system -4(c). This was stirred for 4 hours, causing the chloroform to be absorbed by the toner parent particles 4. In this case, the disperse system -4(a) was mixed in over a period of 20 seconds, so the amount of disperse system -4(a) mixed in per second was 79 parts by weight, so approximately 16% by weight of the disperse system -4(a) was mixed in per second as to the total amount of the disperse system -4(b). Subsequently, dilute sulfuric acid was added and calcium phosphate was dissolved, after which filtering, washing and drying was performed and classification was conducted, thereby obtaining spherical cyan toner particles (4) with number average particle diameter of 5.2 μm. With the cyan toner particles (4), the amount contained of particles 10 μm or greater was 0.6% by number, so neither fine number average particle diameter nor sharp particle size distribution were lost. Measurement of the shape factor (SF-1) of the cyan toner particles (4) showed the SF-1 value to be 112, confirming that the degree of the sphere form increased.

Next, 98 parts by weight of the cyan toner particles (4) and 2 parts by weight of a hydrophobic titanium oxide powder (BET specific surface area of $140m^2/g$) were mixed, thereby preparing a cyan toner (4).

Further, 5 parts by weight of the above cyan toner (4) and 95 parts by weight of coated magnetic ferrite carrier (average particle diameter 45 μm) formed by coating silicone resin with 1% by weight were mixed, thus preparing a two-component developer.

The two-component developer thus obtained was introduced into a full color photocopier (CLC-800, manufactured by Canon), and an image was formed in the monocolor mode with the contrast potential at 250V, resulting in a good image being obtained.

COMPARATIVE EXAMPLE 1

Isoamyl acetate was absorbed into toner parent particles 1 in a disperse system -1(c)' in the same way as with Example 1, except that instead of adding the disperse system -1(a) into the disperse system -1(b), 1000 parts by weight of the disperse system -1(b) was added to 110 parts by weight of the disperse system -1(a) over a period of 20 seconds, thereby producing the disperse system -1(c)'. In this case, the disperse system -1(b) was mixed in over a period of 20 seconds, so the amount of disperse system -1(b) mixed in per second was 50 parts by weight, so approximately 45% by weight of the disperse system -1(b) was mixed in per second as to the total amount of the disperse system -1(a), meaning that the disperse system -1(b) was suddenly added to the disperse system -1(a). Subsequently, cyan toner particles (5) were produced with the same method as Example 1.

Measurement of the obtained spherical cyan toner particles (5) revealed the shape factor (SF-1) to be 110, which is almost a true sphere. However, measuring the number average particle diameter of the cyan toner particles (5) with scanning microscope photography showed the number average particle diameter to be 7.0 μm, and the amount contained of particles 10 μm or greater was 11.2% by number. In comparison with the toner parent particles 1 before the rounding processing, the particle size distribution had deteriorated and broadened. Further, lumps were found to be forming at some parts, creating large particles.

Next, the large particles were removed from the cyan toner particles (5), following which a developer was prepared in the same manner as with Example 1. An image was formed using the obtained developer, resulting in a good image being obtained.

EXAMPLE 5

A toner parent particle 6 was obtained in the same manner as Example 1, except that the phthalocyanine pigment used for producing the toner parent particle 1 was replaced with carbon black. Measurement of the number average particle diameter of the toner parent particles 6 showed the number average particle diameter thereof to be 6.9 μm. The amount contained of toner parent particles 10 μm or greater was 7.5% by number. Measurement of the shape factor (SF-1) of the toner parent particles 6 yielded 155.

Testing for a softener according to the above-described method in order to determine a softener to be used for the toner parent particles 6 showed that the toner parent particle 6 is softened by isoamyl acetate.

A disperse system -6(a) and a disperse system -6(b) were prepared in the same manner as with Example 1, except that while 18 parts by weight of the toner parent particles 1 are in the disperse system -1(a) and 4 parts by weight of softener are in the disperse system -1(b), this is replaced with 110 parts by weight of the toner parent particles 6 and 2 parts by weight of softener. Sampling was performed in the same manner as with Example 1, and observing the dispersion state of each with an optical microscope revealed that the dispersed particles in the disperse system -6(b) were smaller than those in the disperse system -6(a). Next, 200 parts by weight of the disperse system -6(a) were added to 1000 parts by weight of the disperse system -6(b) being stirred at a rotation speed of 200 rpm, and mixed in over a period of 5 seconds. The disperse system -6(a) was mixed in over a period of 5 seconds, so the amount of disperse system -6(a) mixed in per second was 40 parts by weight, so approximately 4% by weight of disperse system -6(a) was mixed in per second per the total amount of the disperse system -6(b). Black spherical toner particles (6) were subsequently obtained in the same manner as with Example 1.

Measurement of the obtained spherical black toner particles (6) revealed the shape factor (SF-1) to be 131, which is somewhat large but generally spherical. The number average particle diameter according to the same method as above was 7.2 μm, and the amount of toner parent particles contained with a particle diameter of 10 μm or greater was 8.0% by number.

A toner 6 was produced using the spherical toner in the same manner as with Example 1, and an image was formed, resulting in a good image being obtained.

EXAMPLE 6

A toner parent particle 7 was obtained in the same manner as Example 1, except that the phthalocyanine pigment used for producing the toner parent particle 1 was replaced with yellow pigment. Measurement of the number average particle diameter of the toner parent particles 7 showed the number average particle diameter thereof to be 8.6 μm. Further, the amount contained of toner parent particles 10 μm or greater was 3.2% by number.

Measurement of the shape factor (SF-1) of the toner parent particles 7 yielded 157.

Testing for a softener according to the above-described method in order to determine a softener to be used for the toner parent particles 7 showed that the toner parent particle 7 is softened by isoamyl acetate.

A disperse system -7(a) and a disperse system -7(b) were prepared in the same manner as with Example 1, except that for the 18 parts by weight of the toner parent particles 1 in the disperse system -1(a) and the 4 parts by weight of softener in the disperse system -1(b) in the case of Example 1, 30 parts by weight of the toner parent particles 7 and 310 parts by weight of softener were substituted. Sampling was performed in the same manner as with Example 1, and observing the dispersion state of each with an optical microscope revealed that the dispersed particles in the disperse system -7(b) were smaller than those in the disperse system -7(a).

120 parts by weight of the disperse system -7(a) were added to 1300 parts by weight of the disperse system -7(b) while being stirred at a rotation speed of 200 rpm, and were mixed in over a period of 2 seconds. Since the disperse system -7(a) was mixed in over a period of 2 seconds, the amount of disperse system -7(a) mixed in per second was 60 parts by weight. Approximately 4.6% by weight of disperse system -7(a) was mixed in per second based on the total amount of the disperse system -7(b). Spherical toner was subsequently obtained in the same manner as with Example 1.

Measurement of the obtained spherical toner particles (6) revealed the shape factor (SF-1) to be 102, which is truly a spherical toner. The number average particle diameter according to the same method as above was 9.9 μm. The amount of toner parent particles contained with a particle diameter of 10 μm or greater was 10.1% by number. Though the number average particle diameter and particle size increased somewhat, spherical toner was obtained.

A toner 7 was produced using this spherical toner in the same manner as with Example 1, and an image was formed, resulting in a good image being obtained.

EXAMPLE 7

A toner parent particle 8 was obtained in the same manner as Example 4, except that while the disperse system -4(a) was poured in over a period of 20 seconds to prepare the spherical toner particles 4 in Example 4, this step was performed in 15 seconds, thereby obtaining spherical toner particles 8. The disperse system -4(a) was mixed in over a period of 20 seconds, and the amount of disperse system -4(a) mixed in per second was 105 parts by weight, so approximately 22% by weight of disperse system 4(a) was mixed in per second based on the total amount of the disperse system -4(b), which is somewhat fast. Measurement of the obtained spherical toner particles (8) revealed the shape factor (SF-1) to be 101, which is truly spherical toner particles. The number average particle diameter measured according to the same method as above was 7.4 μm, and the amount of toner parent particles contained with a particle diameter of 10 μm or greater was 10.4% by number. Though the number average particle diameter and particle size increased somewhat, spherical toner was obtained. A toner 8 was produced using this spherical toner in the same manner as with Example 4, and an image was formed, resulting in a good image being obtained.

EXAMPLE 8

A toner parent particle 9 was obtained in the same manner as Example 2, except that while the 110 parts by weight of the disperse system -2(a) was poured in over a period of 3 seconds in Example 2, this step was performed over a period of 70 seconds, thereby obtaining spherical toner particles 9. The disperse system -2(a) was mixed in over a period of 70 seconds, and the amount of disperse system -2(a) mixed in per second was 2 parts by weight, so approximately 0.2% by weight of disperse system -2(a) was mixed in per second based on the total amount of the disperse system -2(b), which is somewhat slow. Measurement of the obtained spherical toner particles (9) in the same manner as above revealed the shape factor (SF-1) to be 109, which is truly spherical toner particles. The number average particle diameter measured according to the same method as above was 9.1 μm, and the amount of toner parent particles contained with a particle diameter of 10 μm or greater was 10.4% by number. Though the number average particle diameter and particle size increased somewhat, spherical toner was obtained.

A toner 9 was produced using this spherical toner in the same manner as with Example 2, and an image was formed, resulting in a good image being obtained.

Other variations and modifications will be apparent to those of ordinary skill in this art. This invention is not to be limited except the set forth by the claims which follow.

What is claimed is:

1. A process for producing toner particles, comprising the steps of:

(A) preparing toner precursor particles containing at least binder resin and coloring agent; and (B) spherizing the toner precursor particles to produce toner particles;

wherein said spherizing comprises:

(i) dispersing said toner precursor particles in an aqueous medium containing a dispersant, thereby preparing a disperse system (a);

(ii) dispersing oil droplet particles containing a softening agent into an aqueous medium, thereby preparing a disperse system (b);

(iii) preparing a mixed disperse system (c) by adding said disperse system (a) to said disperse system (b), and causing said softening agent to be absorbed by said toner precursor particles in said mixed disperse system (c); and (iv) removing said softening agent from said toner precursor particles.

2. The process according to claim 1, wherein said disperse system (a) is added to said disperse system (b) within one minute, and the amount of said disperse system (a) added per second is within 20% of the total amount of said disperse system (b).

3. The process according to claim 1, wherein the amount of said toner precursor particles contained within said disperse system (a) is 1.6 to 50 parts by weight per 100 parts by weight of said mixed disperse system (c).

4. The process according to claim 1, wherein the amount of softening agent contained within said disperse system (b) is 1.0 to 20 parts by weight per 100 parts by weight of said mixed disperse system (c).

5. The process according to claim 1, wherein at the time of adding said disperse liquid (a) to said disperse liquid (b), the amount of softening agent is 2 to 1000 parts by weight per 100 parts by weight of said toner precursor particles.

6. The process according to claim 1, wherein the average particle diameter of said oil droplet particles contained in said disperse system (b) is smaller than the average particle diameter of said toner precursor particles contained in said disperse system (a).

7. The process according to claim 1, wherein said toner precursor particles have a number average particle diameter of 0.5 μm to 30 μm.

8. The process according to claim 1, wherein the solubility of said softening agent in water at room temperature is within the range of $1\times10^{-6}$ to 10.

9. The process according to claim 1, wherein said toner precursor particles have a shape factor SF-1 exceeding 150, and the obtained toner particles have a shape factor SF-1 of 100 to 120.

10. The process according to claim 9, wherein said preparing step (A) includes at least the steps of:

melt-kneading of at least binder resin and coloring agent to obtain a kneaded material; and pulverizing the kneaded material following cooling to obtain a pulverized material.

11. The process according to claim 1, wherein said softening agent is a compound selected from the group consisting of: long-chain alcohols, alkylester acetates, ketones, aliphatic hydrocarbons, aromatic hydrocarbons, halogenated hydrocarbons, sulfur-containing organic compounds and nitrogen-containing organic compounds.

12. The process according to claim 1, wherein said disperse system (a) contains 0.01 to 5.0 parts by weight of dispersant to 100 parts by weight of toner precursor particles.

13. The process according to claim 12, wherein said dispersant comprises organic dispersant.

14. The process according to claim 12, wherein said dispersant comprises inorganic dispersant.

15. The process according to claim 1, wherein said toner particles have a number average particle diameter of 0.3 to 20 $\mu$m, and the amount of toner particles with particle diameters of 10 $\mu$m or greater is 10% by number or less.

16. The process according to claim 1, wherein said toner particles have a number average particle diameter of 0.3 to 10 $\mu$m, and the amount of toner particles with particle diameters of 10 $\mu$m or greater is 5% by number or less.

* * * * *

UNITED STATES PATENT AND TRADEMARK OFFICE

CERTIFICATE OF CORRECTION

PATENT NO. : 6,106,990
DATED : July 29, 1999
INVENTOR(S) : Yayoi Tazawa et al.

It is certified that error appears in the above-identified patent and that said Letters Patent is hereby corrected as shown below:

Title page, item [56]:
Attorney, Agent, or Firm, "Fitzpartic, Cella, Harper & Scinto" should read
-- Fitzpatrick, Cella, Harper & Scinto --.

Column 7,
Line 61, "later" should read -- latter --.

Column 8,
Line 28, "styrene-acrylonitrile-indenecopolymers;" should read
-- styrene-acrylonitrile-indene copolymers; --.

Column 9,
Line 63, "diethyleneglycol," should read -- diethylene glycol, --.

Column 11,
Line 10, "deterirorates," should read -- deteriorate, --;
Line 20, "preferable" should read -- preferably --; and
Line 52, "81:1, 1, 144," should read -- 81:1, 144, --.

Column 12,
Line 6, "intention" should read -- invention --;
Line 53, "is" should read -- are --; and
Line 54, "is" should read -- are --;

Column 13,
Line 51, "calciumsulfate," should read -- calcium sulfate, --; and
Line 52, "bariumsulfate," should read -- barium sulfate, --.

Column 16,
Line 24, "CLC700," should read -- CLC700; --.

Column 20,
Line 4, "K.K." should read -- K.K.), and --;
Line 5, "was" should read -- were --; and
Line 21, "there by" should read -- thereby --.

UNITED STATES PATENT AND TRADEMARK OFFICE

CERTIFICATE OF CORRECTION

PATENT NO. : 6,106,990
DATED : July 29, 1999
INVENTOR(S) : Yayoi Tazawa et al.

It is certified that error appears in the above-identified patent and that said Letters Patent is hereby corrected as shown below:

Column 21,
Line 35, "was" should read -- were --; and
Line 42, "as to" should read -- based on --.

Column 23,
Line 55, "was" should read -- were --.

Column 24,
Line 11, "the set forth" should read -- as set forth --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*